US005344531A

United States Patent [19]

Saito et al.

[11] Patent Number: 5,344,531

[45] Date of Patent: Sep. 6, 1994

[54] PREVENTION METHOD OF AQUATIC ATTACHING FOULING ORGANISMS AND ITS APPARATUS

[75] Inventors: Kiyomi Saito, Abiko; Morihiko Kuwa, Ageo, both of Japan

[73] Assignee: Nakagawa Corrosion Protecting Co., Ltd., Tokyo, Japan

[21] Appl. No.: 30,398

[22] PCT Filed: Jul. 23, 1992

[86] PCT No.: PCT/JP92/00937

§ 371 Date: Mar. 23, 1993

§ 102(e) Date: Mar. 23, 1993

[87] PCT Pub. No.: WO93/02254

PCT Pub. Date: Apr. 2, 1993

[30] Foreign Application Priority Data

Jul. 24, 1991 [JP] Japan ..... 3-206192
Dec. 12, 1991 [JP] Japan ..... 3-350694
Feb. 18, 1992 [JP] Japan ..... 4-060942

[51] Int. Cl.[5] ..... C23F 13/00; C23F 15/00

[52] U.S. Cl. ..... 204/147; 204/196; 204/231

[58] Field of Search ..... 204/147, 196, 231

[56] References Cited

U.S. PATENT DOCUMENTS 3,766,032 10/1973 Yeiser ..... 204/147

FOREIGN PATENT DOCUMENTS 59-67376 4/1984 Japan ..... 204/196

*Primary Examiner*—John Niebling
*Assistant Examiner*—Arun S. Phasge
*Attorney, Agent, or Firm*—Bucknam and Archer

[57] ABSTRACT

This invention relates to a method of preventing or controlling aquatic attaching fouling organisms which comprises covering aquatic organisms attaching portions on the surfaces of submerged structures or intake facilities with a plurality of mutually insulated metallic covers made of iron, magnesium, aluminum or their alloys through an insulating material and a cushion; using each of the metallic covers as an electrode; forming an electric circuit using the metallic covers facing each other as a pair; connecting the electrodes to a D.C. power supply having a polarity reversal function so as to supply a current between both poles either continuously or intermittently; and reversing the polarity of the current so that when one of the metallic covers is an anode, the surface of the metal constituting the metallic cover is dissolved and activated, and attachment of the aquatic fouling organisms to the surfaces of the metallic covers is prevented or controlled.

25 Claims, 14 Drawing Sheets

| (Season) | (Winter) | (Spring) | (Summer) | (Fall) | |
|---|---|---|---|---|---|
| Average Sea Water Temperature | < 14.0 °C | > 14.0 °C | > 22.0 °C | > 17.0 °C | 20.5 °C |

PREVENTION METHOD OF AQUATIC ATTACHING FOULING ORGANISMS AND ITS APPARATUS

TECHNICAL FIELD

This invention relates to a prevention or control method of aquatic attaching fouling organisms attaching and breeding on water contact surfaces of intake passes of power stations, iron foundries, oil refinery plants, ere, using water such as brine as cooling water, intake facilities such as screens, and submerged steel and concrete structures to be submerged and constructed in sea water such as piers, steel piles and steel pipe piles, and equipment used for the method.

BACKGROUND ART

Aquatic organisms inhabiting in water such as bacterias, seaweeds, shellfishes, etc, attach and breed on water contact portions of various harbor facilities such as quays, piers, platform piers, buoys, and submerged structures such as ships and greatly lower the functions of such facilities and submerged structures.

The quantity of cooling water or power generation water for various intake equipment such as plant intake passes, intake pipes and screens, which is used as cooling water in steam power stations, atomic power stations, iron foundries, oil refinery plants, etc. or as power generation water of power stations, ranges from dozens of thousands of cubic meters to hundreds of thousands of cubic meter per hour and is extremely great. Therefore, maintenance management of the intake equipment is of great importance. The essential points of this maintenance management are corrosion control of the facilities and control of attachment of aquatic organisms attaching and breeding on the surfaces of the intake facilities in the same way as in the submerged structures. Attachment and breeding of the aquatic organisms are causes for the occurrence of various troubles in the normal operations of equipments and facilities.

Excellent corrosion prevention engineerings such as the development of corrosion resistant materials, the progress in coatings and cathodic protection have been developed and put into practical applications as corrosion prevention control means of these submerged structures and Intake facilities.

On the other hand, prevention means against attachment of aquatic fouling organisms such as marine creatures have long been employed. In other words, the following means have been proposed:

(1) adding chlorine or hypochlorites;
(2) coating of anti-fouling paints;
(3) covering with anti-fouling metals;
(4) formation of chlorine or hypochlorite ions by brine electrolysis; and
(5) formation of copper ion using a copper anode.

All of these methods are effective as prevention means against attachment of marine organisms, but they are anti-fouling means or methods comprising principally the formation of the toxic ions such as chlorine, hypochlorite, copper, mercury, tin, and there is the possibility that these toxic ions induce secondary environmental pollution. The formation and use of these toxic ions require great expenses for installations for keeping a suitable concentration or density for a long service life and for the maintenance and management of the installations; but mainly because they use the toxic ions and may result in environmental destruction rather than because of expenses, the use of such installations tends to be inhibited.

Chlorine and hypochlorites can be charged easily, but the concentration management is difficult. If any reducing agents or substances exist in water, the consumption amount of chlorine becomes greater, and the anti-fouling effect cannot be expected in some cases. A great deal of labor and expenses are necessary for maintenance and management of a chlorine generation apparatus and its concentration management, and secondary environmental pollution is not avoidable. Therefore, the use of such compounds is now avoided as much as possible.

Anti-fouling coatings or paints mostly contain metal pigments generating toxic ions, and comprise mainly mercury, mercury compounds, copper, copper alloys and their compounds. Recently, these materials have been replaced gradually by organic stannous compounds (stannates), but the service life as the coating is about 2 years. These paints involve the problem of low durability resulting from impact, wear and tear. Furthermore, the use of such coatings tends to be inhibited from the aspects of environmental pollution and safety in the same way as in the case of chlorine.

Covering with the anti-fouling metals is the method which applies a covering of copper or a copper alloy to the submerged area of the structure and controls attachment of the aquatic fouling organisms by the toxic copper ion slightly eluting from the surface of copper or the copper alloy. However, this method needs to cover the entire surface of the structure and to perfectly insulate the structure (made of iron steel). (If any defect occurs in the covering metals, unusual corrosion occurs in the underlayer structure.) For these reasons, the cost of the covering work is high. It is one of the anti-fouling methods based on the toxic ion, and secondary environmental pollution is not avoidable.

Anti-fouling means of marine organisms on the wall surfaces of submerged structures, particularly the intake facilities of plants using large quantities of brine as cooling water, most widely employ the formation of chlorine and hypochlorites by electrolysis of brine or the formation of the copper ion by the use of a copper anode.

It is known to generate chlorine, particularly the hypochlorites, by direct electrolysis of brine. Various attempts have been made to attain higher economy and higher safety. For example, Japanese Patent Publication No.(Sho.) 51-41030 (41030/1976) describes a sea water electrolysis system for generating hypochlorites. Similarly, Japanese Patent Publication No.(Sho.) 54-40472 (40472/1979) discloses an anti-fouling and anti-corrosion method using a hypochlorite formation apparatus in combination with an iron ion generating system by sea water electrolysis, and Japanese Patent Laid-Open No. (Hei.)2-236290 (236290/1990) discloses an anti-fouling system using an electrode material obtained by applying an insoluble conductive film and a conductive film made of a highly conductive material to the submerged structure through an insulating film in place of a platinized titanium and carbon electrode as the conventional hypochlorite forming anode.

Sea water electrolytic technique using a copper anode for forming toxic ions has long been known. For example, Japanese Patent Publication No. (Sho.) 41-5193 (5193/1966) describes a prevention method of aquatic attaching fouling organisms by D.C. electrolysis by disposing a copper anode and a cathode in the proximity of inner wall surfaces of sea water intake underdrains or open drains so as to elute the copper ion by D.C. electrolysis, and Japanese Patent Publication No.(-Sho.) 45-923 (923/1970) describes a method which disposes a pair of copper electrodes on the inner surface of a sea water intake pipe and supplies an A.C. or a current reversible direct current voltage. Similarly, Japanese Patent Publication No. (Sho.) 43-6374 (6374/1968) describes a method which prevents attachment of aquatic fouling organisms by sea water electrolyzed by copper or copper alloy anode in sea water and adds cathodic protection means by using the objective structure as the cathode.

Japanese Patent Laid-Open No.(Sho.) 59-9181 (9181/1984) describes a prevention method of aquatic attaching fouling organisms on the outer surfaces of submerged metal structures such as ships by applying a plurality of anti-fouling metals (principally copper or copper alloys) on time submerged areas.

Anti-fouling means using other metals in place of copper or using these metals in combination with copper has also been proposed. For example, Japanese Patent Publication No.(Sho.) 48-39343 (39343/1973) discloses a method which prevents fouling of hulls of ships by covering the hulls with a zinc layer, uses the zinc layer as the anode while the ships are at rest by the use of an auxiliary electrode, and uses the zinc layer as the cathode during moving. Japanese Patent Publication No.(Sho.) 59-40361 (40361/1984) discloses another method which feeds a D.C. current to an anode made of copper or a copper alloy and at least one kind of metals selected from the group consisting of zinc, aluminum, magnesium and iron, and disposed in the proximity, or at an intermediate part, of an intake port of a cooling pipe system of sea water or brackish water, which allows the copper ions to be adsorbed and concentrated by hydroxide colloid of the anode metal, and thus enhances the anti-fouling effect of the aquatic attaching fouling organisms and at the same time, inhibits the outflow of the copper ion into sea water.

A method of preventing marine bio-fouling by generating a combination of A.C. and D.C. currents in order to elute controlled chlorine and copper ions into sea water is disclosed in Japanese Patent National Publication No.(Sho.) 63-502172 (502172/1988) (WO 087/03261).

Anti-fouling means of the aquatic attaching fouling organisms by forming the chlorine and hypochlorite ions by the electrolysis of sea water or by utilizing the toxic character of the copper ion, etc, by the electrolysis using copper or the copper alloy as the anode are effective means, but they extirpate useful marine organisms in addition to secondary environmental pollution.

According to Japanese Patent National Publication No.(Sho.) 63-502172 (502172/1988) described above, the action potential of the marine organisms at the nerve/muscle interface is disrupted by the use of the A.C., and the possibility of their attachment of the structures is lowered. This method is said to be the means which controls attachment of the marine fouling organisms but does not extirpates them. As a method not involving the formation of the toxic ions, Japanese Patent Publication No.(Hei.) 1-46595 (46595/1989) discloses a method which, when the metal structures are constructed by valve metals such as titanium, deposit of a precious metal oxide catalyst on the surface of the valve metal, connects the metal structure to the anode of a D.C. power supply, inhibits the formation of chlorine, generates oxygen and hydrogen gases and prevents deposit of marine fouling organisms and scales consisting of calcium compounds. This method is directed to heat exchanger pipes made of the precious valve metal such as titanium. However, it is not industrially preferable to cover the surface of facilities, which are great both in the quantity and in the number, or the surface of the structures which are exposed to marine tidal currents changing incessantly, by the oxide catalyst coating valve metal.

As described above, various anti-fouling means for preventing attachment of the aquatic attaching fouling organisms inhabiting and growing on the submerged areas of the marine structures have been developed, but none of them are entirely satisfactory. In other words, they involve the problems that the toxic ions are generated, secondary environmental pollution may be induced, maintenance management of the equipments is not easy, the running cost is high, and even useful aquatic organisms are extirpated.

For example, intake facilities of power stations, ere, introducing large quantities of sea water as cooling water have the problem of getting rid of aquatic fouling organisms expanding over one thousand meters. At present, the removing operation is mechanically carried out by a manual operation (workers or divers) or using robots. In addition to its low removal efficiency, this method involves a large number of safety problems, requires an enormous removal cost, and needs a disposal and waste site of the marine organisms thus removed. Therefore, not only economical but also industrial losses are very large.

SUMMARY OF THE INVENTION

The object of the present invention is to provide a prevention and control method of aquatic attaching fouling organisms having high efficiency and high economy and its equipments, which do not rely on the generation of chlorine and toxic ions, are free from secondary environmental pollution and moreover, do not extirpate the aquatic organisms.

The inventors of the present invention have paid a specific attention to the fact that attachment and habitation of marine organisms can be hardly observed on the surface of an electrode functioning as an anode in conventional cathodic protection which has been applied to corrosion control of marine structures such as hulls of ships, harbor facilities, etc, by sea water, and have completed the present invention by utilizing and applying this phenomenon to intake facilities for which anti-fouling measures of marine organisms has been very difficult. The inventors of the present invention have realized further that this method can be applied to other marine structures, and intake facilities and submerged structures in fresh water and brackish water, and have completed the present invention.

Fundamentally, the present invention is based on the observation that attachment and breeding of aquatic organisms can be scarcely observed or are drastically controlled on active dissolving portions by anodic electrolysis of metals selected from transition metals for generating non-poisonous ions, without using metals generating chlorine or toxic ions.

Species and breeding seasons of aquatic organisms are different depending on seasons and sites, as will be described in more detail next. The marine organisms that cause problems in sea-water, for example, marine structures and marine intake facilities, are mussels, barnacles, sea squirts, oysters and seaweeds such as sea lettus and green laver. Particularly in the case of intake facilities (intake passes) of power stations, mussels account for 80% of the fouling organisms and barnacles do the rest, and the prevention of attachment of these marine organisms is a great technical problem. Generally, their attachment can be hardly observed at low temperature in winter season. They attach and grow in a warm season from spring to summer, and breed from fall to winter, but new attachment is not observed. The aquatic attaching fouling organisms cannot attach unless bacteria and slimes attach to a substratum. Therefore, prevention control of their attaching can be accomplished by preventing the attachment of these bacterias and slimes to the substratum, or even if they do, by preventing in advance the growth of their larvae.

As described above, the present invention does not relate to the prevention and control method of the aquatic attaching fouling organisms by their extinction by the toxic ions but prevents and controls the method of their attachment.

In other words, the gist of the present invention resides in the following points.

(1) A prevention and control method of aquatic attaching fouling organisms comprising: covering attaching portions of aquatic fouling organisms on the surfaces of submerged structures or intake facilities with a plurality of mutually insulated metallic covers made of iron, magnesium, aluminum or their alloys through an insulating material and a cushion material; using the metallic covers as electrodes, respectively; composing an electric circuit using a pair of the metallic covers facing each other; connecting the electric circuit to a D.C. power supply having a current reversal function; supplying a current between both of the electrodes either continuously or intermittently; and reversing a current polarity so that when one of the metallic covers is an anode, the surface of the metal constituting the metallic cover is dissolved and activated, and attachment of the aquatic fouling organisms is controlled or prevented.

(2) A prevention and control method of aquatic attaching fouling organisms comprising: covering attaching portions of aquatic fouling organisms on the surfaces of a submerged structure with a metallic cover made of iron, aluminum, magnesium or their alloys through an insulating material and a cushion material; connecting the metallic cover to a positive pole of a D.C. power supply and using it as an anode; connecting the submerged structure to a negative pole of the D.C. power supply to use it as a cathode and to form an electric circuit; and supplying a current between the cathode and the anode either continuously or intermittently so as to prevent or control the attachment of the aquatic fouling organisms to the surface of the anode metallic cover by dissolving and activating the surfaces of the metallic cover.

(3) A prevention and control method of aquatic attaching fouling organisms comprising: covering attaching portions of aquatic fouling organisms on the inner surfaces of an intake facility other than its bottom surface with a plurality of mutually insulated metallic covers made of iron, magnesium, aluminum or their alloys through an insulating material and a cushion material; connecting the metallic covers to positive pole of a D.C. power supply and using them as an anode; disposing iron or an iron alloy material on the bottom surface of the intake facility and connecting it to a negative pole of the D.C. supply to use it as a cathode to form an electric circuit; and supplying a current between the cathode and the anode either continuously or intermittently so that the surfaces of the metals constituting the metallic cover are dissolved and activated, and so that attachment of the aquatic fouling organisms to the surfaces of the metallic cover is controlled or prevented.

The structures to which the present invention are directed are submerged structures and intake facilities in sea water, fresh water and brackish water.

Here, the term "submerged structures" represents various harbor facilities constructed in water such as quays, piers, platform piers and buoys and ships, and made primarily of iron steel materials and concrete materials.

The term "intake facilities" represents intake passes and intake pipes for cooling and power generation, and structures using such intake facilities are various factories and plants such as steam power or water power stations, iron foundries, oil refinery plants. The cross-sectional views of the surfaces of these intake facilities are rectangles, circles, ovals, squares, etc, and their shapes are arbitrary.

According to the present invention, the wall surfaces of these submerged structures and intake facilities, on which the aquatic fouling organisms are likely to attach, are covered with mutually insulated metallic covers made of iron, aluminum, magnesium or their alloys, through an insulating material and a cushion. A synthetic rubber such as neoprene and silicon rubber, and plastics such as PVC, polyethylene and polyester are used as the insulating material. Blistered polyethylene sheets, blistered polyurethane sheets, etc, are used as the cushion. One of these materials may be used as the insulating material and the cushion. A synthetic rubber or a plastic of 10 mmt or more is used as this insulating-cushion material. The coating of the metallic covers is fixed to the surfaces of the submerged structures by the use of customary means as insulating bolts and adhesives.

A pair of these metallic covers facing each other are used as electrodes so as to form an electric circuit, and are connected to a D.C. power supply having a current reversal function. The current is supplied between both electrodes either continuously or intermittently, and the current polarity is reversed so that when one of the metallic covers is the anode, the surface of the metal constituting the metallic covers is dissolved and activated and attachment of the aquatic fouling organisms is controlled or prevented. The electric circuit formed hereby may have a combination function with A.C.

To reduce the time during which the metallic cover is the cathode, the reversal interval of the current is preferably carried out at the interval of 10 seconds to 60 minutes.

When the current is supplied intermittently, an interval between the current supply and the nonsupply is preferably shortened. Generally, this gap is preferably from 10 seconds to 60 minutes. When the current is supplied for 4 hours per day, this 4 hours' time is preferably divided as finely as possible when supplying the current.

When the structure is the submerged structure, the portions of the structures to which the aquatic fouling organisms attach are covered with the metallic cover made of iron, aluminum, magnesium or their alloys through the insulating material and the cushion material in the same way as described above. The metallic cover is connected to the positive pole of the D.C. power supply and is used as the anode while the structure is connected to the negative pole of the D.C. power supply so as to form the electric circuit. The current is supplied between the anode and the cathode either continuously or intermittently, so that the surface of the metallic cover can be dissolved and activated and attachment of the aquatic fouling organisms to the surface of this anode metallic cover can be prevented or controlled. In this case, water functions as an electrolyte. As a result, attachment of the aquatic Fouling organisms to the surface of the metallic cover in contact with water is controlled and since the current flows into the submerged structure, surrounding corrosion can be controlled. The electric circuit in this case need not always have the polarity reversal function.

Since the electric circuit is formed between the anti-fouling metallic cover and the submerged structure in this case, their direct short-circuit must be avoided. Therefore, a sheet-like product or molded product having a similar shape to the outer shape of the submerged structure is preferably used as the anti-fouling metallic cover.

A protective cover is applied in some cases to water-line portions of the submerged structure such as piers for the purpose of corrosion protection. In this case, the metallic cover described above may be applied to the submerged structure by removing the corrosion protection cover of the outermost layer applied below the water line or below water, through the insulating material and the cushion in place of this corrosion protection cover. In this way, the submerged structure is protected by both the above prevention control method of the aquatic attaching fouling organisms and the protective cover.

Generally, sand, mud, etc, are likely stay at the bottom portions of the intake facilities and since these portions have insufficient supply of oxygen (air), the aquatic fouling organisms can hardly grow up at such portions. In such a case, the portions of the intake facilities at which the aquatic fouling organisms attach, other than the bottom surface, are covered with the insulated metallic cover through the insulating material and the cushion material, and this metallic cover is connected to the positive pole of the D.C. power supply and is used as the anode. On the other hand, iron or its alloy is disposed on the bottom surface of the intake facilities, is connected to the negative pole of the D.C. power supply and is used as the cathode. These anode and cathode together constitute an electric circuit, and the current is supplied between them either continuously or intermittently so as to dissolve and activate the surface of the metal constituting the metallic cover and to prevent or control the attachment of the aquatic fouling organisms. The electric circuit obtained In this case need not always have the current reversal function.

In the present invention, active dissolution of the electrode due to the anode current prevents or controls attachment of the aquatic fouling organisms. Therefore, there is an anode current density which is suitable for the prevention or control. Though the anode current density is preferably great, it 1s preferably not more than 500 $mA/m^2$ (0.5 $A/m^2$) from the economical and industrial aspects, more preferably from 40 to 500 $mA/m^2$ (0.04 to 0.5 $A/m^2$) and further preferably, 150 to 300 $mA/m^2$ (0.15 to 0.3 $A/m^2$). It is also preferred to regulate the anode current density, either regularly or irregularly, in accordance with the species or active living time of the aquatic fouling organisms.

An apparatus preferably used for the prevention method of aquatic fouling organisms according to the present invention comprises a multi-layer structure fitted to attaching portions of aquatic fouling organisms on the surfaces of submerged structures or intake facilities, and comprising an insulating material, a cushion material and a metallic cover made of iron, aluminum, magnesium or their alloys; and a D.C. power supply capable of supplying a current between the metallic covers or between the metallic cover and the submersed structure; or comprises a multi-layer structure fitted to attaching portions of aquatic fouling organisms on the inner surfaces of intake facilities other than its bottom surface, and comprising an insulating material, a cushion material and a metallic cover made or iron, aluminum, magnesium or their alloys; iron or its alloy member disposed on the bottom surface of the intake facility; and a D.C. current supply capable of supplying a current between the metallic cover and the iron or iron alloy member.

As the prevention apparatus against the aquatic attaching fouling organisms, an apparatus the D.C. power supply of which constitutes an electric circuit having a current reversing function, an intermittent current supply function or a combination function with A.C. is used preferably.

The present invention uses iron, aluminum, magnesium and their alloys, the dissolved ions of which have hardly any toxicity or are said to be harmless, as the anode in water. Therefore, the aquatic fouling organisms hardly attach to the surface of the metal, and even when they do, their adhesive strength to the metal surface is very low and they easily fall off from time metal surface. Moreover, the formation of time chlorine gas due to electrolysis hardly occurs even in the case of sea water, and the formation of the oxygen gas and the hydrogen gas is hardly observed, either.

The reason why attachment of the aquatic fouling organisms is restricted by dissolution of the anode metal by the D.C. electrolysis without the formation of such toxic ions and gases has not yet been clarified sufficiently, but is assumed as follows: Namely, when a D.C. voltage is loaded between the anode metal and the cathode metal, active dissolution of the anode metal occurs to fall short of attaching conditions of the aquatic Fouling organisms, so that these organisms lose their attaching abilities.

BEST MODE FOR CARRYING OUT THE INVENTION

Hereinafter, the present invention will be explained definitely with reference to embodiments thereof, but the invention is in no way limited by these embodiments.

EMBODIMENT 1

Experiments were carried out for the relation between an anode current density, the species of aquatic fouling organisms and the quantity of their attachment when active dissolution was effected using an iron steel as an anode.

An iron steel sheet (having the inside with an insulating cover) of 3.2 t×350 w×450 Lmm was connected to a positive pole of a D.C. power supply and was used as an anode Inside a natural marine zone facing Suruga Bay, Shizuoka Prefecture, as a substantially average sea area in Japan, and another iron steel member disposed separately was used as an opposed cathode. A constant current was supplied between the cathode and the anode so as to examine the conditions of attachment of marine organisms to the surface of the anode iron steel material, a consumption rate of the anode and an anode potential.

The anode current density was set to 14 stages from no-current for control to 3,000 mA/m$^2$ (i.e. 0, 10, 20, 30, 50, 100, . . . , 3,000 mA/m$^2$). The period of the current flow started from early winter (toward the end of December) during which the marine organisms were said to be non-active, passed through active seasons (spring to early summer), breeding and best growing season (early summer to early fall) and ended in moderate growing season (early fall to early winter) for about one year.

Figure 1:
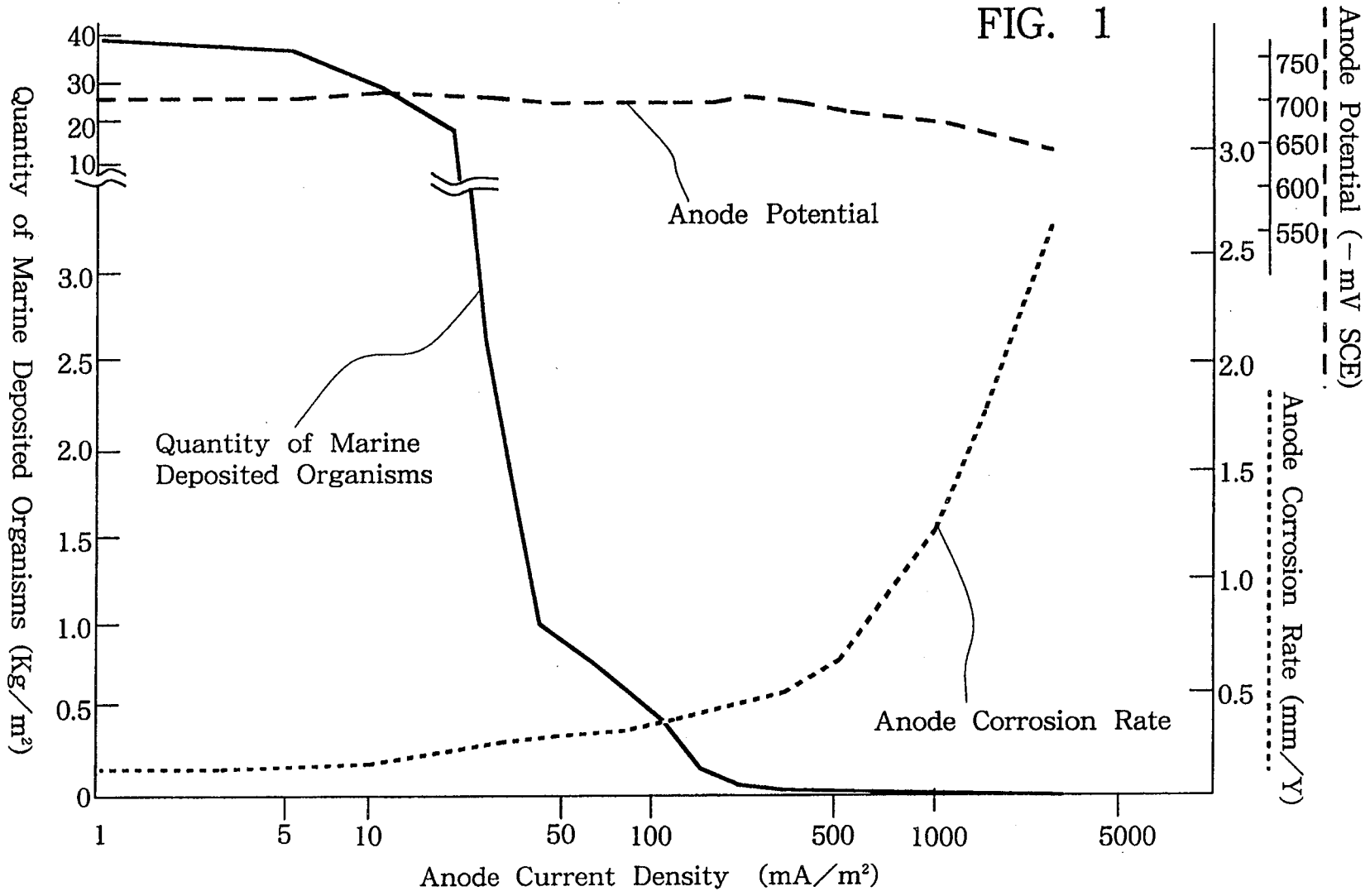
FIG. 1 is a graph showing the relation between an anode current density of a current which is constant throughout the year, the quantity of marine deposited organisms on the surface of the anode, an anode corrosion rate and an anode potential.

Fig. 1 shows the quantity of the marine organisms, the anode corrosion rate and the anode potential-anode current density relation after the supply of power for about a year. In the drawing, a solid line represents the quantity of the aquatic fouling organisms for each anode current density, a dotted lines represents anode corrosion rate, and a dash line represents the anode potential.

As shown in FIG. 1, the attaching quantity of the marine organisms decreased with the increase of the anode current density, and dropped drastically when the anode current density exceeded 40 to 50 mA/m$^2$. Furthermore, when the anode current density exceeded 100 mA/m$^2$, the attaching quantity of the marine organisms was below 0.5 kg/m$^2$, which could be substantially neglected, and was close to 0 at 200 mA/m$^2$.

On the other hand, the anode corrosion rate was naturally greater than 0.1 to 0.2 mm/Y of a normal corrosion rate, and became greater with a higher current. When the current exceeded 500 mA/m$^2$, the anode corrosion rate became 3 times that of natural corrosion and drastically increased.

As is obvious from the explanation given above, the anode current density is up to 500 mA/m$^2$, is from 40 to 500 mA/m$^2$ from the industrial and economical aspects as well as from the aspect of environmental preservation, and is most preferably 150 to 300 mA/m$^2$.

The anode potential somehow got to a noble potential when time anode current density exceeded 500 mA/m$^2$, but was below −600 mV even at 3,000 mA/m$^2$ and was hardly polarized from the normal potential of the steel. In other words, in comparison with 1.0 V (SCE) as the evolution potential of chlorine in sea water, it was by far based and the occurrence of chlorine could not at all be considered.

When the relation between the deposited marine organisms and the anode current density was examined in further detail, large quantities of various organisms such as mussels, barnacles, sea squirts, tube worms, etc, attached to all the surfaces of the electrode without a current, and they grew to a thickness of 10 to 20 cm. When the current density was less than 40 mA/m$^2$, large quantities of barnacles and sea squirts attached. Though attachment of mussels could be observed partially, this attachment dropped drastically or became nil at the current density of 40 to 50 mA/m$^2$, and barnacles, sea squirts and tube worms attached locally. When the current density was more than 100 mA/m$^2$, attachment of almost all the marine organisms could not be observed, and matured lavae of barnacles were observed spottedly or seaweeds could be observed. Also, yellow brown products could be observed. These products could be easily removed when rubbed with fingers, and the steel surface having a metal luster could be observed below these products.

EMBODIMENT 2

Activity of the marine organisms exhibits a seasonal change. For example, the species and attaching quantity of these marine organisms attaching to fixed structures such as intake passes and submerged structures change with seasons, that is, four seasons, months, water temperatures, and so forth, and their habits also change. In this embodiment, therefore, the attaching conditions were tested by dividing a year into four periods (first period: the last third of December to the second third of March, second period: the last third of March to the second third of June, third period: the last third of June to the second third of September, fourth period: the last third of September to the second third of December), and the attaching conditions in each three month's period were examined because the experiments were carried out for full one year in Embodiment 1. The sea water temperatures were 14.0° C. for the first period, 16.6° C. for the second period, 24.3° C. for the third period and 18.8° C. for the fourth period, and the seasons corresponded to these water temperatures, respectively.

Figure 2:
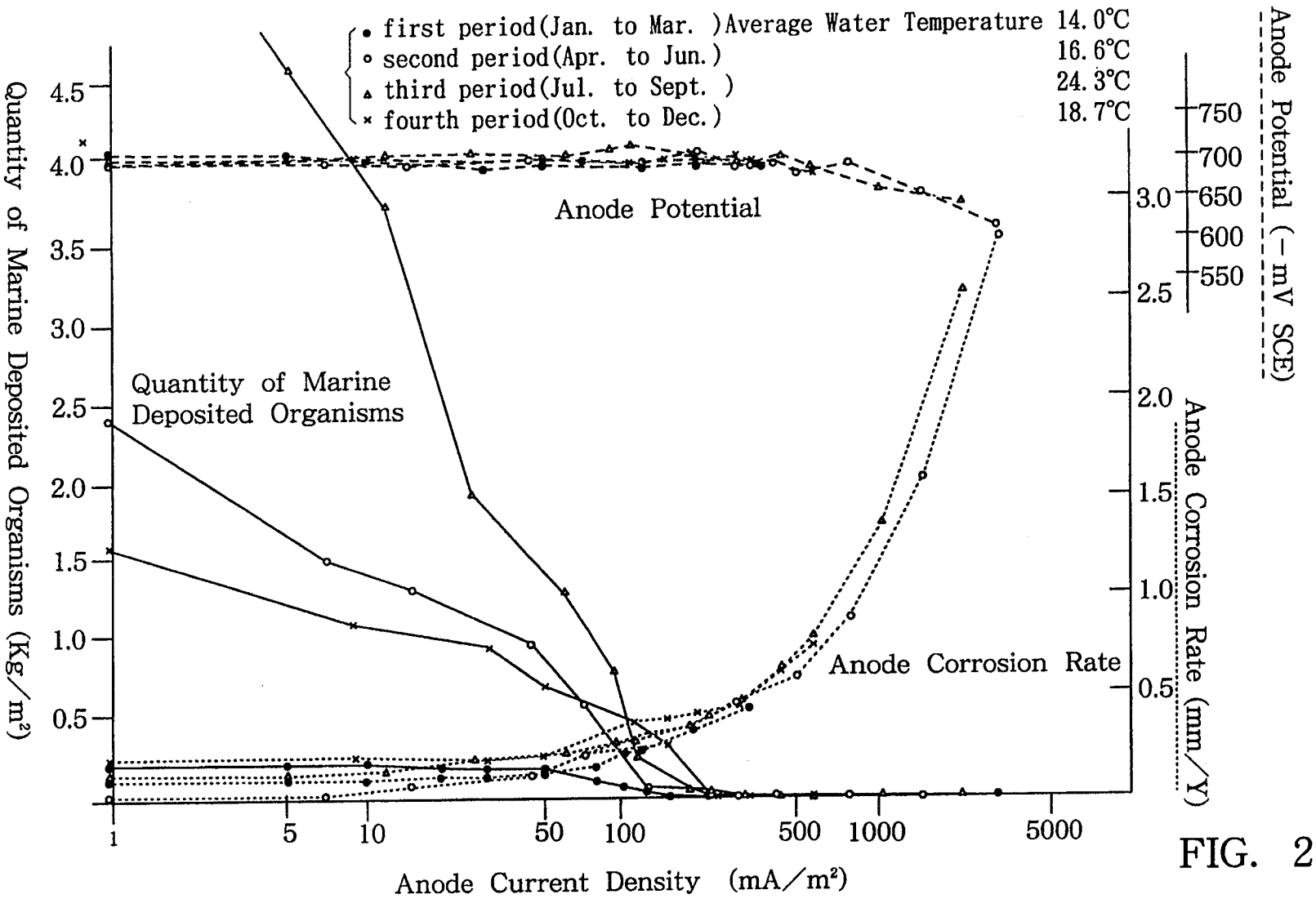
FIG. 2 is a graph showing the relation between an anode current density, the quantity of marine deposited organisms, an anode corrosion rate and an anode potential, by season.

The results of the experiments were tabulated in FIG. 2. In this diagram, a solid line represents the attaching quantities of each period (season), a dotted line represents the anode consumption rate and a dash line does the anode potential.

The attaching quantity of the marine organisms decreased with an increasing anode current density, and this tendency resembled that of the experiment for full one year shown in FIG. 1. The attaching quantity of the marine organisms was smaller in each period even in the case of the non-supply of the current in comparison with the case of the supply of the current, because a new steel material was charged in each period.

When evaluation was made for each period, it was found that the attaching quantity of the marine organisms was 0.3 to 0.4 kg/m$^2$ even when the current was not supplied, in the first winter period (average water temperature=14.0° C.), and this value was at a negligible level.

In the second period as the active attaching season when water started to warm (average water temperature=16.6° C.), attaching of mussels was accelerated, and barnacles, sea squirts and seaweeds started attaching. The attaching quantities of these marine organisms to the anode surface decreased with the increase in the anode current density, and when the density exceeded 40 to 50 mA/m$^2$, the attaching quantity decreased drastically, and could be substantially neglected at more than 120 mA/m$^2$ as the quantity dropped to not more than 0.2 kg/cm$^2$.

Attachment, growth and reproduction of the marine organisms became remarkable irrespective of their species in the third period as the hot summer period (average water temperature=24.3° C.). In this period, new attachment of mussels could be hardly observed but attachment of barnacles and sea squirts became greater. The attaching quantities of the marine organisms were the greatest in this period in which the growth and reproduction of the marine organisms were vigorous. Although the attaching quantities decreased with the increase in the anode current density, the attaching quantities were some multiples of other seasons at a low current density. The attaching quantity was not more than 0.5 kg/m$^2$ at 100 mA/m$^2$, and could be neglected substantially at more than 130 mA/m$^2$ because the quantity was not more than 0.2 kg/m$^2$.

Since new attachment of the marine organisms decreased in the fourth period (average water temperature =18.8° C.) where activity of the marine organisms was stable, the overall attaching quantity dropped and the attaching tendency was similar to that of the second period. In this period, attachment of barnacles and white sea squirts was observed to some extents but new attachment of mussels was hardly observed.

On the other hand, the anode consumption rate was represented by a corrosion rate (mm/Y), and the tendency was similar to a corrosion tendency of the year round experiment. In any case, the anode consumption rate became great when the anode current density exceeded 500 mA/m$^2$, and this was not advantageous from the industrial and economical aspect and also from the conservation of environment.

The most optimum anode density for limiting the corrosion rate to not more than 0.5 mm/Y and minimizing the attaching quantity of the marine organisms was 100 to 400 mA/m$^2$.

The anode potential, too, was similar to that of the year round experiment, and the generation of chlorine could not be believed as described in Embodiment 1.

EMBODIMENT 3

Figure 3:
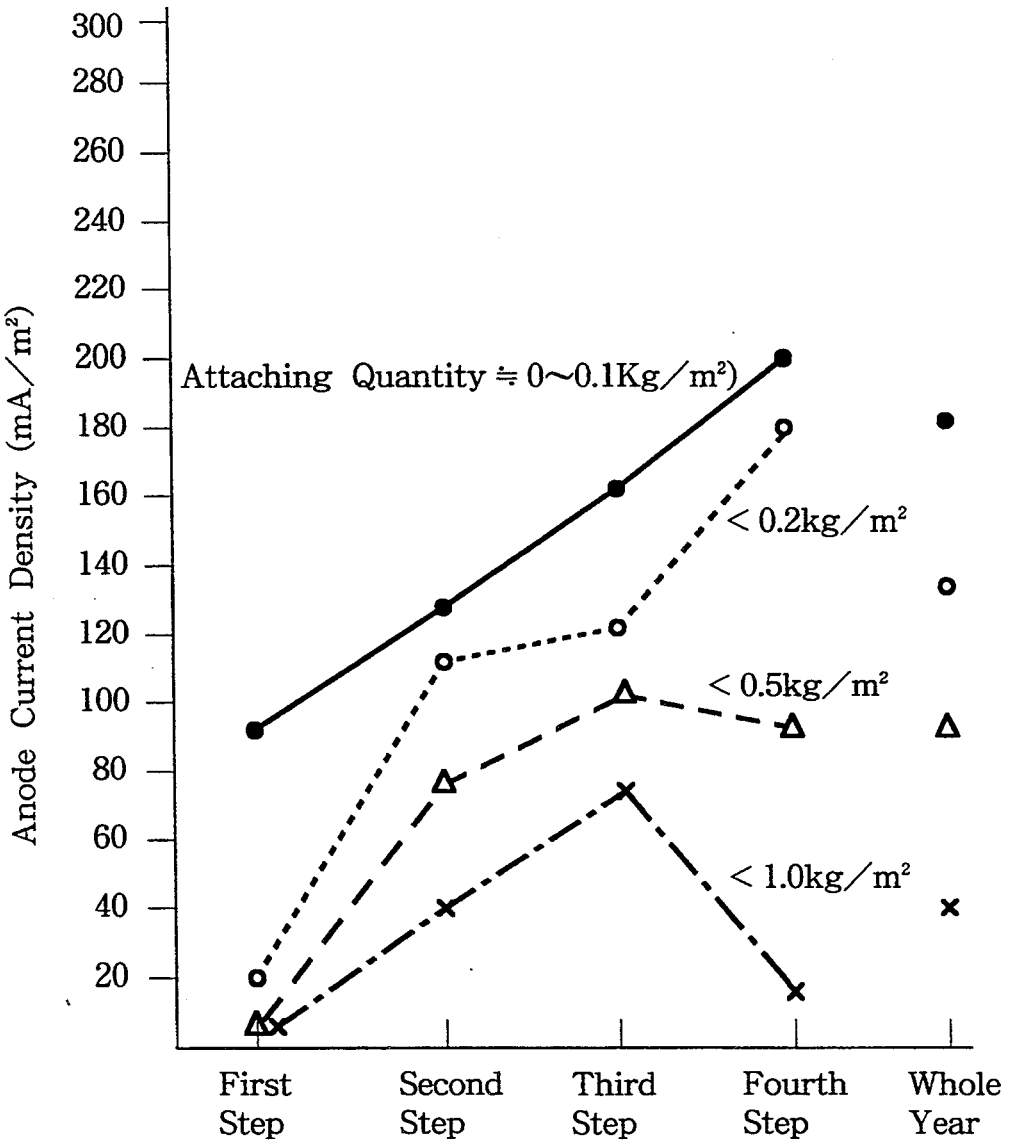
FIG. 3 is a graph showing the relation between the quantity of marine deposited organisms and a critical anode current density throughout the year and by season.

A critical anode current density for limiting the attaching quantity of the marine organisms to less than 1.0 kg/m$^2$, less than 0.5 kg/m$^2$, less than 0.2 kg/m$^2$ and 0.1 k/m$^2$in the year round experiment and the first to fourth periods was measured, and the result was shown in FIG. 3.

As the attaching quantity of these marine organisms was brought closer substantially to zero, the critical anode current density had to be increased. To limit the attaching quantity to less than 0.2 kg/m$^2$ (generally, below 1/100 of the attaching quantity 30 to 40 kg/m$^2$ of the marine organisms under the natural state), the anode current density had to be at least 140 mA/m$^2$ in the year round experiment, but in accordance with the periods, the anode current density was less than 20 mA/m$^2$ in the first period, 110 mA/m$^2$ in the second period, 130 mA/m$^2$ in the third period and 180 mA/m$^2$ in the fourth period. One of their values in four periods was higher than the anode current density in the year round experiment, but these values were 110 mA/m$^2$ on an average. In other words, the current could be reduced to 80% of the constant current through the year round.

EMBODIMENT 4

Figure 4:
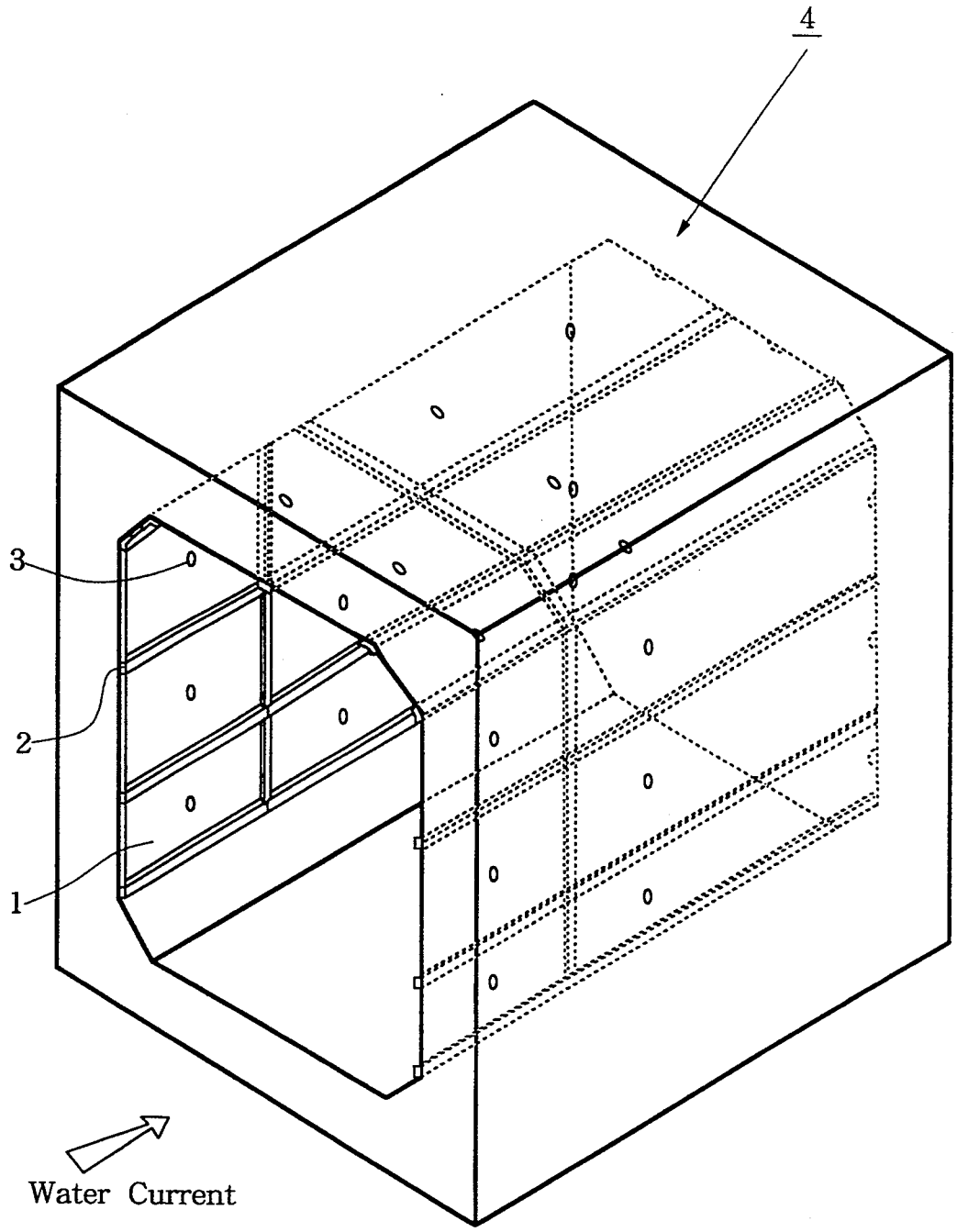
FIG. 4 is a perspective view showing an embodiment of an anti-fouling apparatus for aquatic fouling organisms according to the present invention which is installed in a box culvert type intake pass.
Figure 5:
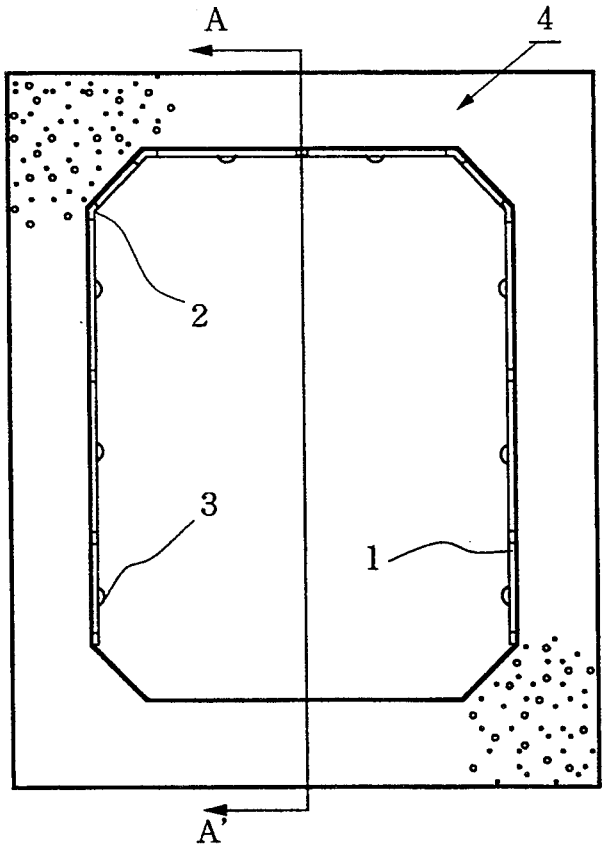
FIG. 5 is a sectional view of the anti-fouling apparatus for aquatic attaching fouling organisms shown in FIG. 4.
Figure 6:
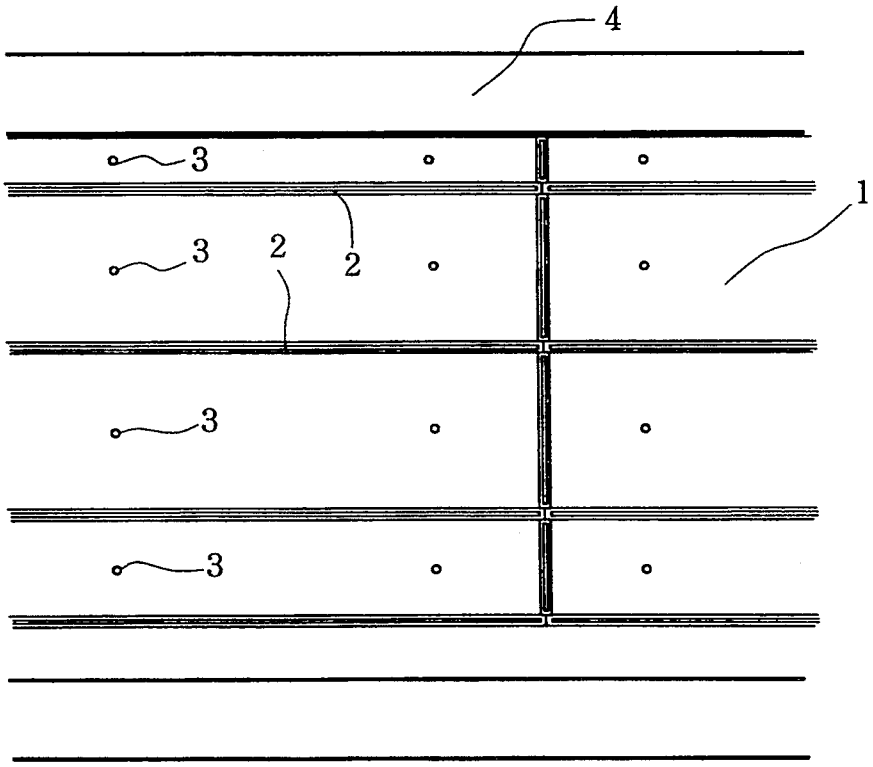
FIG. 6 is a side view of a portion A-A' in FIG. 5.

FIG. 4 is a perspective view showing an embodiment of a prevention apparatus against marine attaching organisms according to the present invention installed in a box culvert type intake facility, FIG. 5 is a sectional view of the apparatus shown in FIG. 4, and FIG. 6 is a side view of a portion A-A' in FIG. 5. In FIGS. 4 to 6, reference numeral 1 denotes a panel shape laminator (electrode); 2 is an insulating frame (electrode support); 3 is fixing means (bolts); and 4 is marine intake facilities (cooling water intake pass). In FIG. 4, an arrow represents a water flow direction. In FIGS. 4 to 6, a D.C. power supply for supplying a current to each panel shape laminator is not shown. The inner wall portion of this cooling water intake pass 4 had a width of 2.4 m, a height of 3.0 m and a length of 200 m.

As shown in FIGS. 4 to 6, a plurality of panel shape laminators 1 serving as the electrodes were fitted to all the inside wall surfaces (objective area=180 m$^2$) of the cooling water intake pass 4 other than its bottom surface. The shape of cross-section of the inside wall surfaces of this cooling water intake pass 4 was rectangular as shown in FIG. 5.

Each panel shape laminator 1 consisted of a multi-laminator (by bonding a back surface insulator and a cushion) of an SS 400 steel sheet, and had a width of 0.85 m, a length of 1.8 m and a thickness of 1.6 mm.

The electrode support 2 (width: 0.1 m, length: 4 m) made of FRP (fiber reinforced polymer) was used for the insulation between the panel shape laminators 1 and fixed support bolts 3 of a resin cure-and -bury type (tradename: "Chemical Anchor") were used for fixing. A recess was formed on the surface of this FRP electrode support 2 and was filled up with a self polishing anti-fouling paint to prevent attachment of the marine organisms.

A definite fixing method is as follows. Each panel shape laminator 1 was inserted and clutched into a support groove of the FRP electrode support 2 fixed to the wall surface of the cooling water intake facility using the chemical anchor in consideration of the retention of the strength to the flow velocity and uniform consumption of the anode (panel shape laminator) 1. Furthermore, to prevent vibration of the panel shape structure 1, the fixed supporting bolts 3 were applied at the center of the laminator 1 in its longitudinal direction with 2 spots between them.

Figure 7:
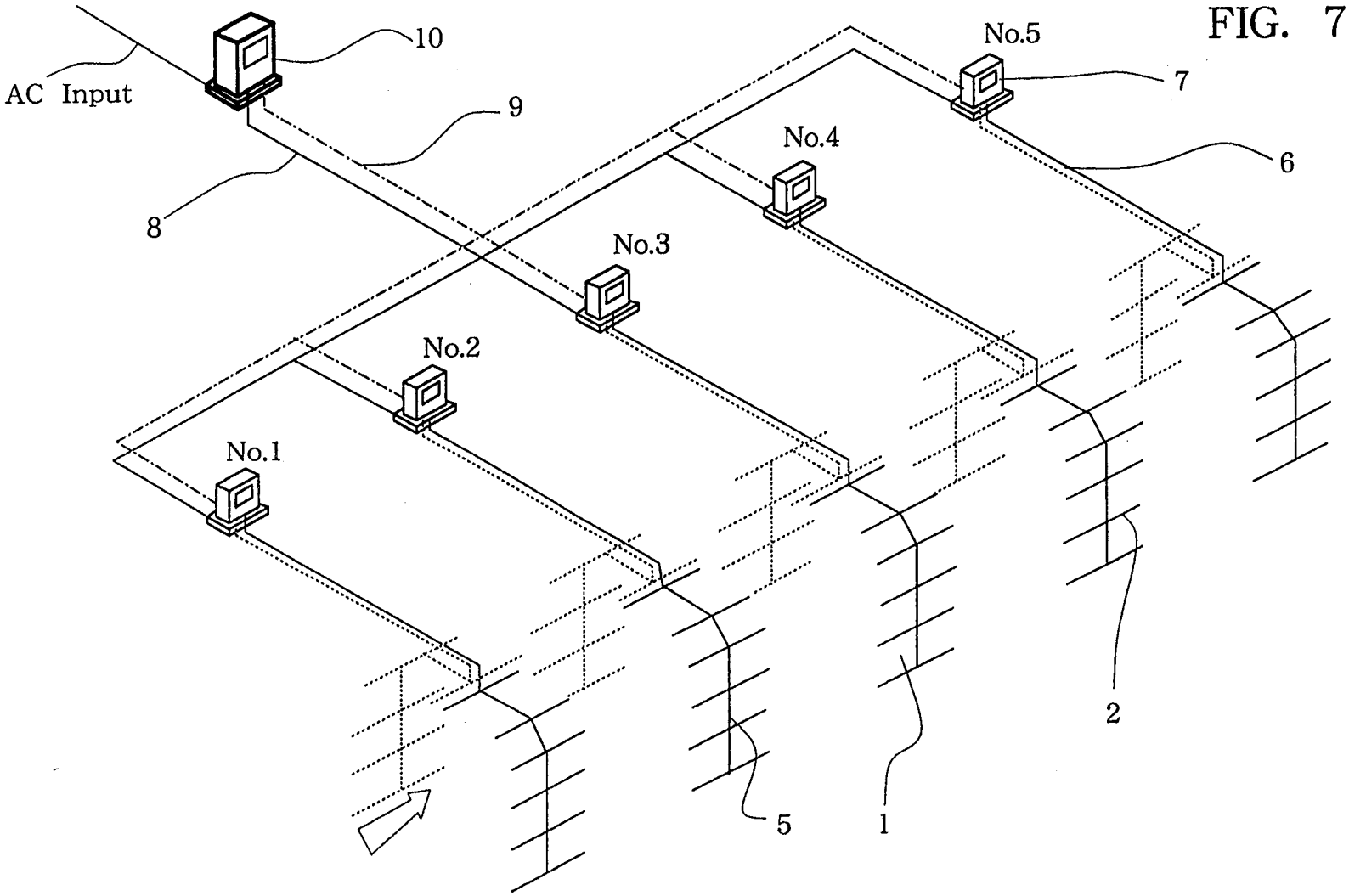
FIG. 7 is a diagram of distributing lead wires off the anti-fouling apparatus of marine organisms shown in FIG. 4.

FIG. 7 shows a lead wiring figure of this prevention apparatus against the marine attaching organisms. Reference numerals are the same as those used in FIG. 4. Reference numeral 5 represents a connecting wire, 6 is a D.C. circuit, 7 is a D.C. power supply, 8 is an A.C. circuit, 9 is a control circuit, and 10 is a control box ( concentric control apparatus ).

The D.C. circuit 6 was connected to the D.C. power supply 7 using an intake pass cable fitted to the back of each panel shape structure as the connecting wire 5 and using a CV cable for the underground portion. The panel shape laminators 1 on the facing inside wall surfaces form a pair and the D.C. circuit 6 was connected to the D.C. power supply 7 so that the panel shape laminators function as the anode and the cathode, respectively. The D.C. power supply 7 was of a full wave rectification type, has output power of DC 20 V×80 A, and selectively supplied power in accordance with the instruction from the control box 10 having the concentric control function of current reversal and intermittent current supply. The control box 10 normally received power of AC 600 V, 3 $\phi$, converted it to 200 V, 3 $\phi$ and supplied it to the D.C. power supply 7. At the same time, the control box 10 controlled the operation of the D.C. power supply 7 by the concentric control function, and monitored the attaching state of the marine organisms on the wall surfaces of the intake pass through a monitor. To reduce the power loss due to the voltage drop of the D.C. circuit 6 and the material and work costs of the pipings and lead wires, the D.C. power supply 7 was divided into five segments and were disposed near the cooling water intake pass 4 as shown in the drawing. Five D.C. power supplies 7 were disposed as one circuit for each of these segments, and each of the D.C. supplies 7 were concentrically managed by the control box 10.

Figure 8:
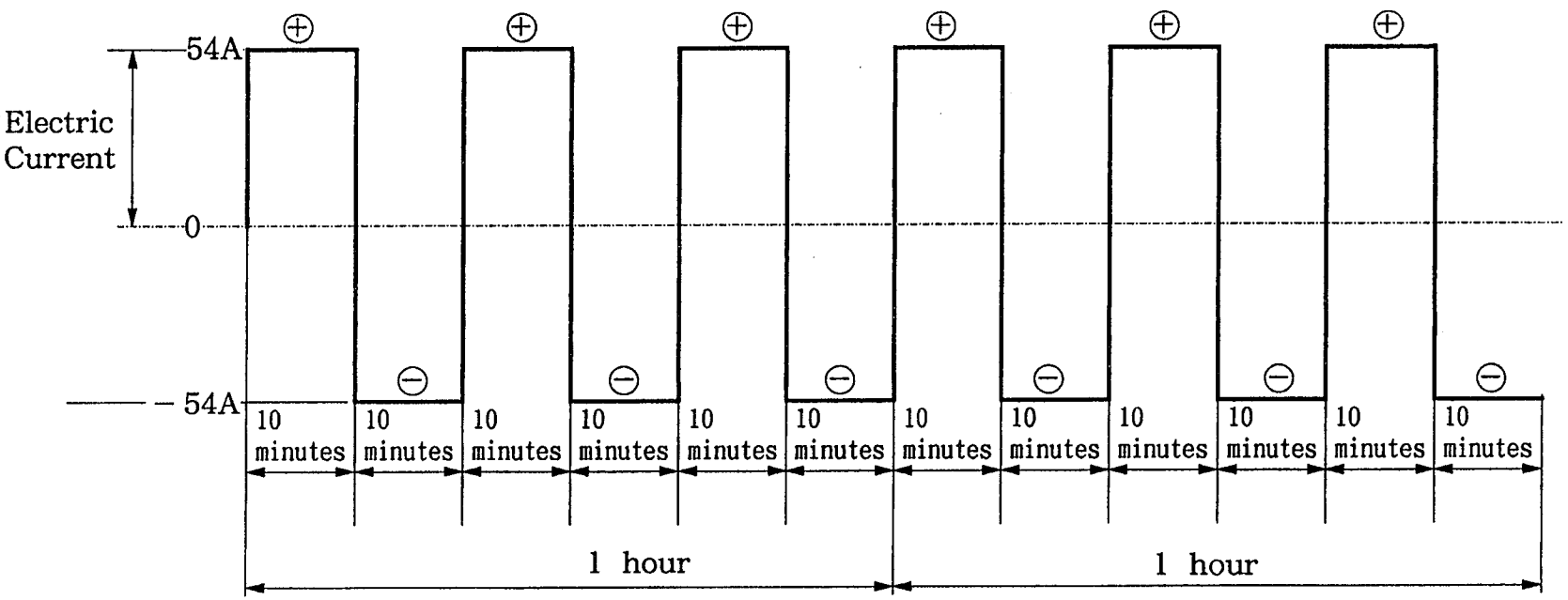
FIG. 8 is a time chart showing an example of an operation cycle of a current flow.

The current was supplied by dividing one hour into three cycles by the polarity reversal mechanism assembled in the D.C. power supply. FIG. 8 shows a time chart as an example of this current supply operation cycle. In this operation cycle, the current supplied is 54 A (0.3 A/m$^2$) and the operation was carried out for about 50 days from the spring season as the reproduction season of the marine organisms. As a result, attachment of the marine organisms on the surface of the panel shape laminators could be hardly observed, and the surface exhibited a blackish brown color. Thereafter, the current was reduced to 5.4 A (0.03 A/m$^2$), but attachment of the marine organisms was not observed even after the passage of 70 days, though attachment of seaweeds was partly observed. In contrast, in similar cooling water intake passes not subjected to any anti-fouling treatment, marine organisms such as seaweeds, barnacles, mussels, etc, attached to the surfaces of the intake passes, and were observed growing day by day in this season.

During the operation, the anode potential of the panel shape structure was −600 to −710 mV (SCE) and did not reach 1.1 V (SCE) which was the chlorine generating potential in sea water, and chloride was not generated. The cathode potential of the panel shape laminator was a less noble potential than −900 mV, and was completely corrosion-proofed. Though attachment of the marine organisms to these panel shape laminators due to the electrolytic reaction was observed, they could be removed easily by current reversal. The electrolytic voltage was 2.0 to 4.0 V. When the current was reduced to 5.4 A, the voltage showed 1.0 to 1.5 V.

EMBODIMENT 5

Figure 9:
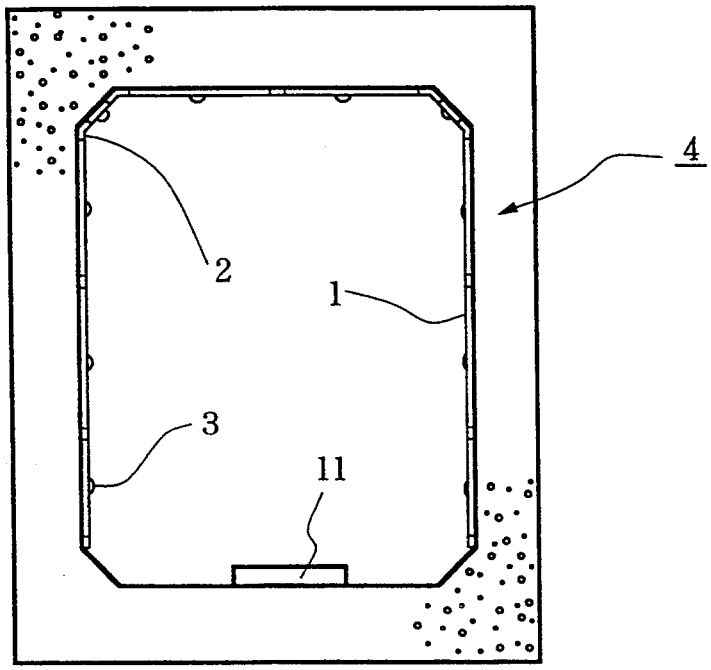
FIG. 9 is a sectional view showing the anti-fouling apparatus for marine organisms according to another embodiment of the present invention.

FIG. 9 is a sectional view showing the prevention apparatus against marine organisms according to another embodiment of the present invention. In the drawing, like reference numerals are used as in FIGS. 4 to 6, and reference numeral 11 denotes a cathode material.

In this apparatus, a plurality of panel shape laminators 1 as the anode were fitted to all the inside wall surfaces of the cooling water intake pass 4 other than its bottom surface in the same way as in Embodiment 4 (objective area: 180 m$^2$). A cathode material 11 made of a steel was disposed on the inside wall bottom surface of the cooling water intake pass 4.

Figure 10:
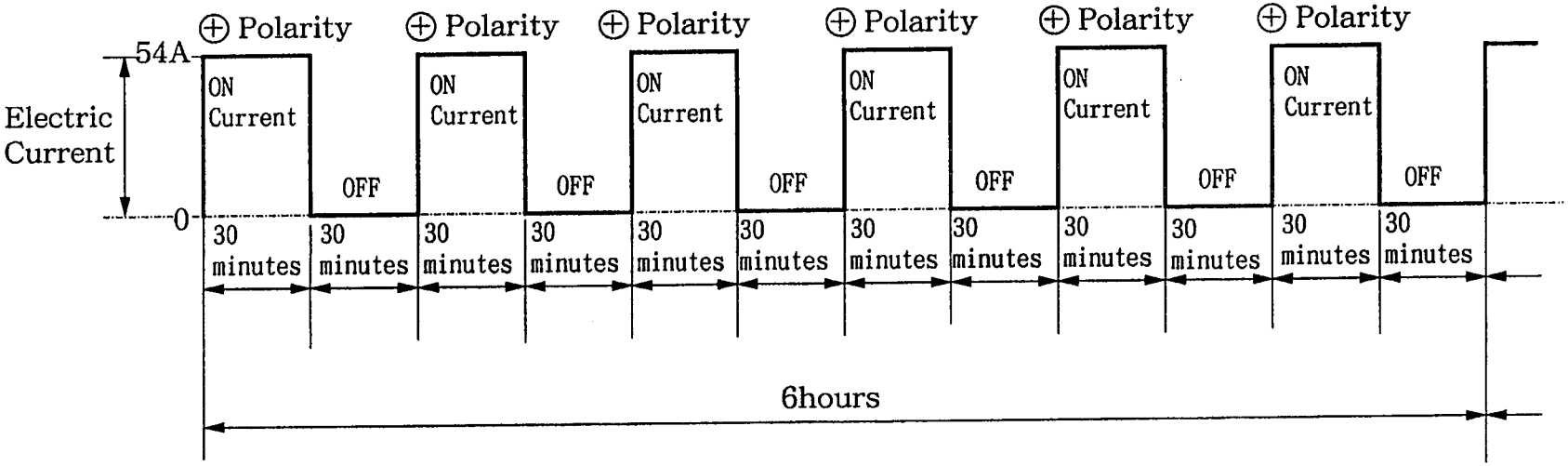
FIG. 10 is a time chart showing an example of the operation cycle for the current supply.

An electric circuit was constituted using a plurality of panel shape laminators as the anode and the cathode material 11 as the cathode, and a current was supplied under the same condition as that of Embodiment 4. In other words, the current was 54 A (0.3 A/m$^2$), and ON/OFF of the current was repeated. One cycle consisted of ON and OFF for 30 minutes, respectively, and the operation of 24 cycles/day was carried out. This time chart is shown in FIG. 10.

As a result, attachment of the marine organisms could be hardly seen on the surface of the panel shape laminators in the same way as in Embodiment 4 even after the passage of 50 days, and the surface remained blakish grown. The surface area of the cathode was extremely smaller than that of the anode panel shape laminators and was under the over-protection state. Therefore, a coating consisting of calcium and magnesium was hardly deposited to the cathode surface but peeled off, and attachment of the marine organisms was hardly observed.

EMBODIMENT 6

Figure 11:
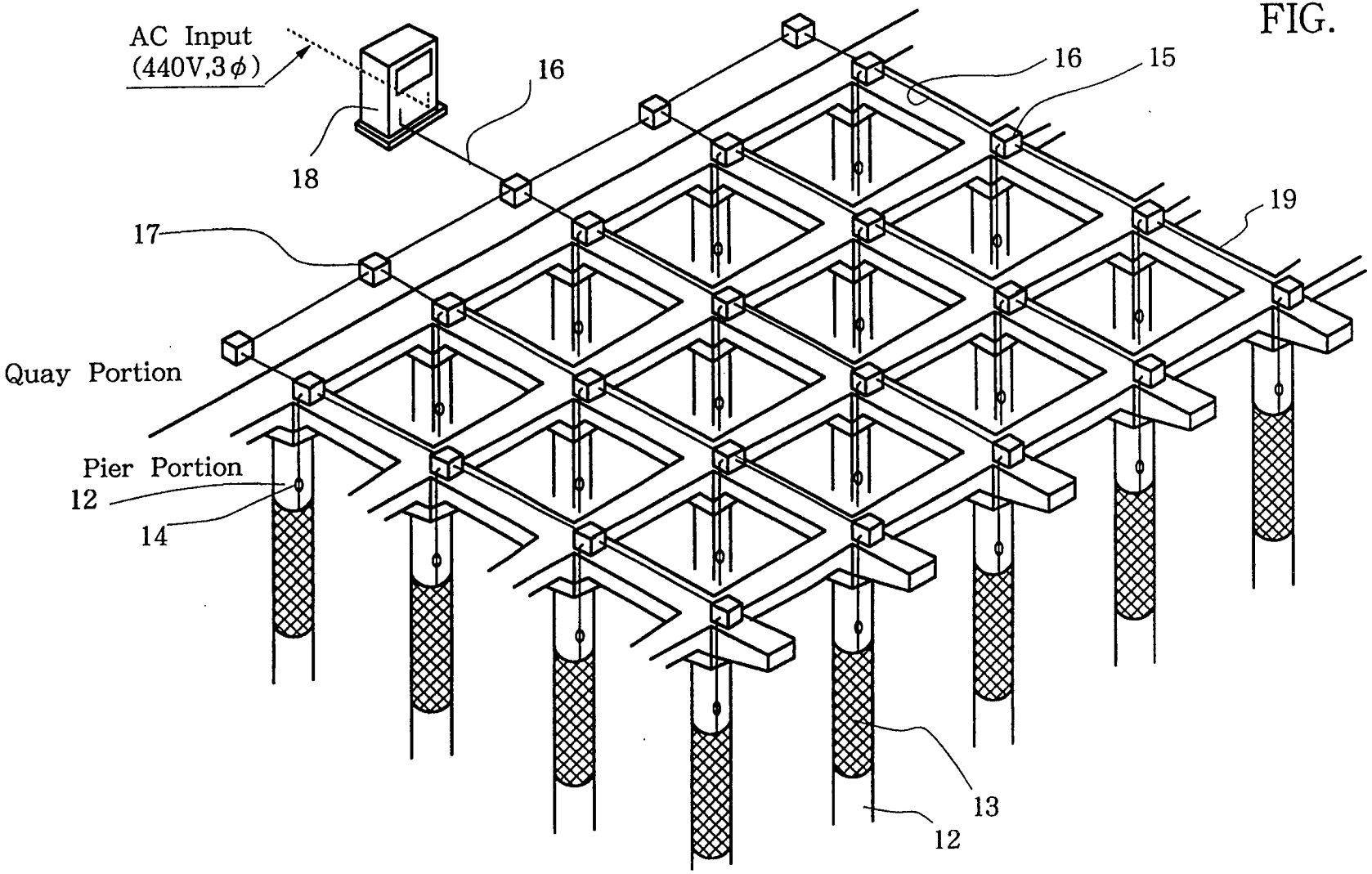
FIG. 11 is a perspective view showing the state where the present invention is applied to base steel pipe piles of a pier.
Figure 12:
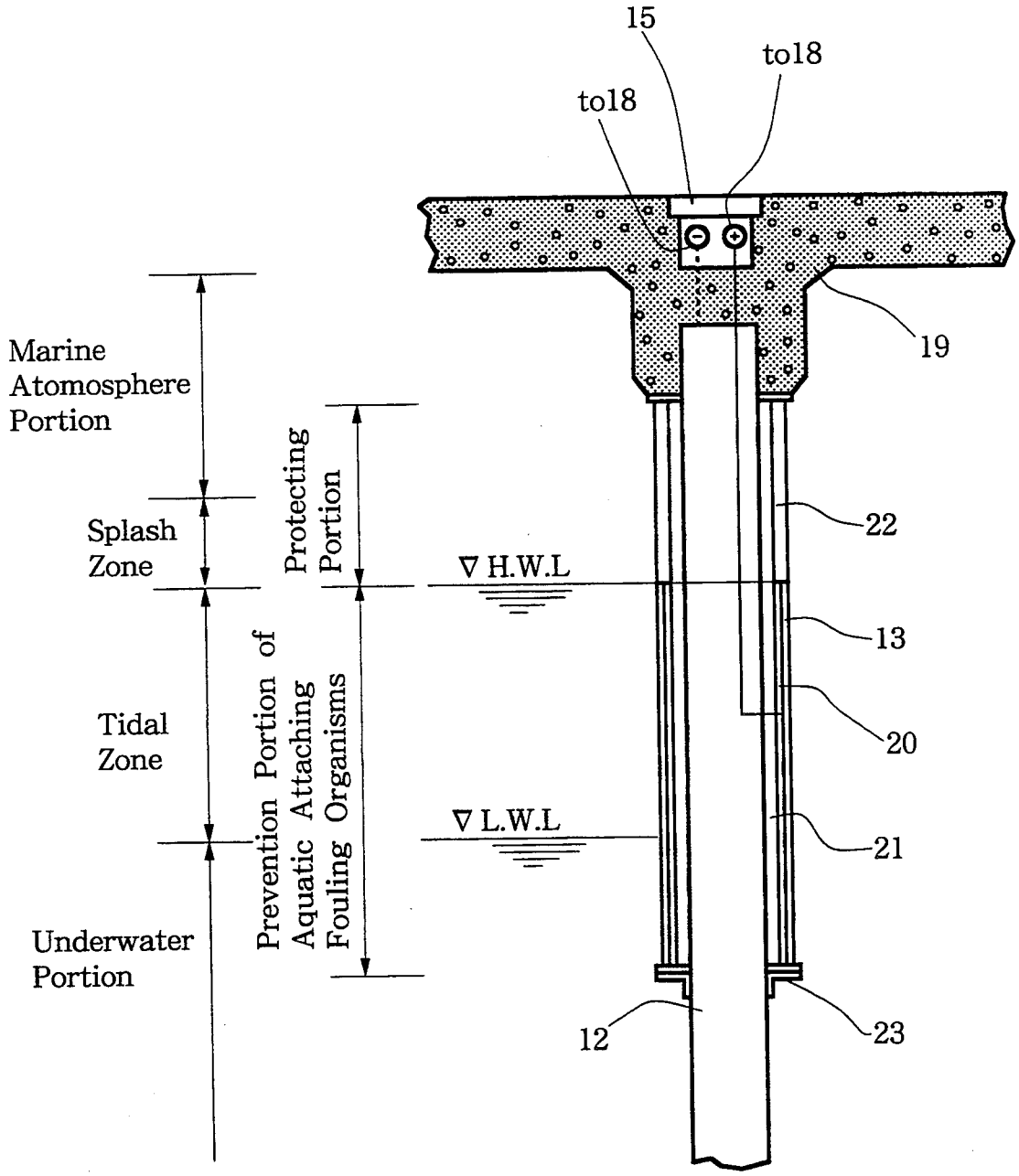
FIG. 12 is a sectional view showing an example where the anti-fouling apparatus for marine organisms is fitted to one base steel pipe pile shown in FIG. 11.

FIG. 11 is a perspective view showing another embodiment of the present invention applied to steel pipe piles of substructures of piers. FIG. 12 is a sectional view of the steel pipe pile portions of the substructure. This embodiment was directed to the steel pipe piles of one block of the piers, and one block had a planar shape of a length of 36 m and a width of 12 m, the outer diameter of the steel pipe piles of the substructure was 800 mm, and these piles were disposed in an arrangement of 5 rows by 4 columns. FIG. 11 shows the lead wires in magnification.

In FIGS. 11 to 12, reference numeral 12 denotes a marine structure (steel pipe piles of the pier), 13 is a metal member (anode), 14 is a cathode terminal, 15 is a connection box for electrodes, 16 is a D.C. lead wires, 17 is a distribution box, 18 is a D.C. power supply, 19 is an upper structure of the pier, 20 is an insulation/cushion material, 21 is a corrosion protecting material, 22 is a corrosion protecting cover, and 23 is fixing means. Symbol H.W.L. represents a high water level line, and L.W.L does a low water level line.

The steel pipe piles 12 were provided with the corrosion protecting material 21 such as a petrolatum paste, petrolatum tape and a plastic blistering material, and with the corrosion protecting cover 22 made of FRP with the tidal zone being the center.

As shown in FIG. 12, a part of the FRP protecting cover 22 as the outermost layer of this corrosion-proof coating, that is, the marine organisms attaching portion, was removed, and a steel sheet 13 (metal member) having a thickness of 2.3 mmt was wound through the insulation/cushion material 20, and was fastened and fixed to the steel pipe piles 12 by the fixing means 23.

To use the steel sheet 13 as anode, an electric circuit contact was disposed on the back of the steel sheet and insulation coated wires were fitted. The lead wires were extended to the connection box 15 for electrode provided on the superstructure of pier and were connected to the positive pole of the D.C. power supply 18. On the other hand, another lead wire was connected to the steel pipe piles 12, was taken into the connection box 15 for electrodes, and was connected to a negative pole of the D.C. power supply 18.

In the steel pipe pile pier shown in FIG. 11, cathodic protection by galvanic aluminum alloy anodes was applied to the steel pipe piles which was always kept below water surface. Therefore, the prevention apparatus against the marine organisms in this embodiment was disposed so as to cover the portion 1 m below L.W.L up to H.W.L.

This prevention apparatus against the marine organisms was practiced for 20 steel pipe piles of one block, and corrosion protective covering was applied to other blocks as usual and cathodic protection was applied to the portions kept always below the sea water level. The work was finished in the fall season, and the supply of the current was started in early spring when the marine organisms started their activity. Observation was made after about a year through the active periods of spring, summer and fall.

The continuous current was supplied at a rate of 50 $mA/m^2$ in the early active season of the marine organisms, and at rates of 250 $mA/m^2$ in April to May, 200 $mA/m^2$ in June to August, 100 $mA/m^2$ in September, 50 $mA/m^2$ in October, and 20 $mA/m^2$ in November, respectively, but no current was supplied during December to February.

The ON/OFF supply of the current in a 30 minutes' unit with a constant current quantity per day was applied to part of the steel pipe piles during April and May as the best reproduction season.

As a result, attachment of the marine organisms in a thickness of about 15 to 20 cm was observed on the steel pipe piles not using the prevention apparatus of this embodiment below and near the water level, but in the case of the steel pipe piles using the prevention apparatus, attachment of slimes, seaweeds or extremely small shellfishes was observed in a part of the steel pipe piles. When the attaching quantities of the marine organisms were measured, the values were 40 to 60 $kg/m^2$ for the former and not more than 0.5 $kg/m^2$ for the latter, which was below 1/100 of the prior art.

EMBODIMENT 7

Figure 13:
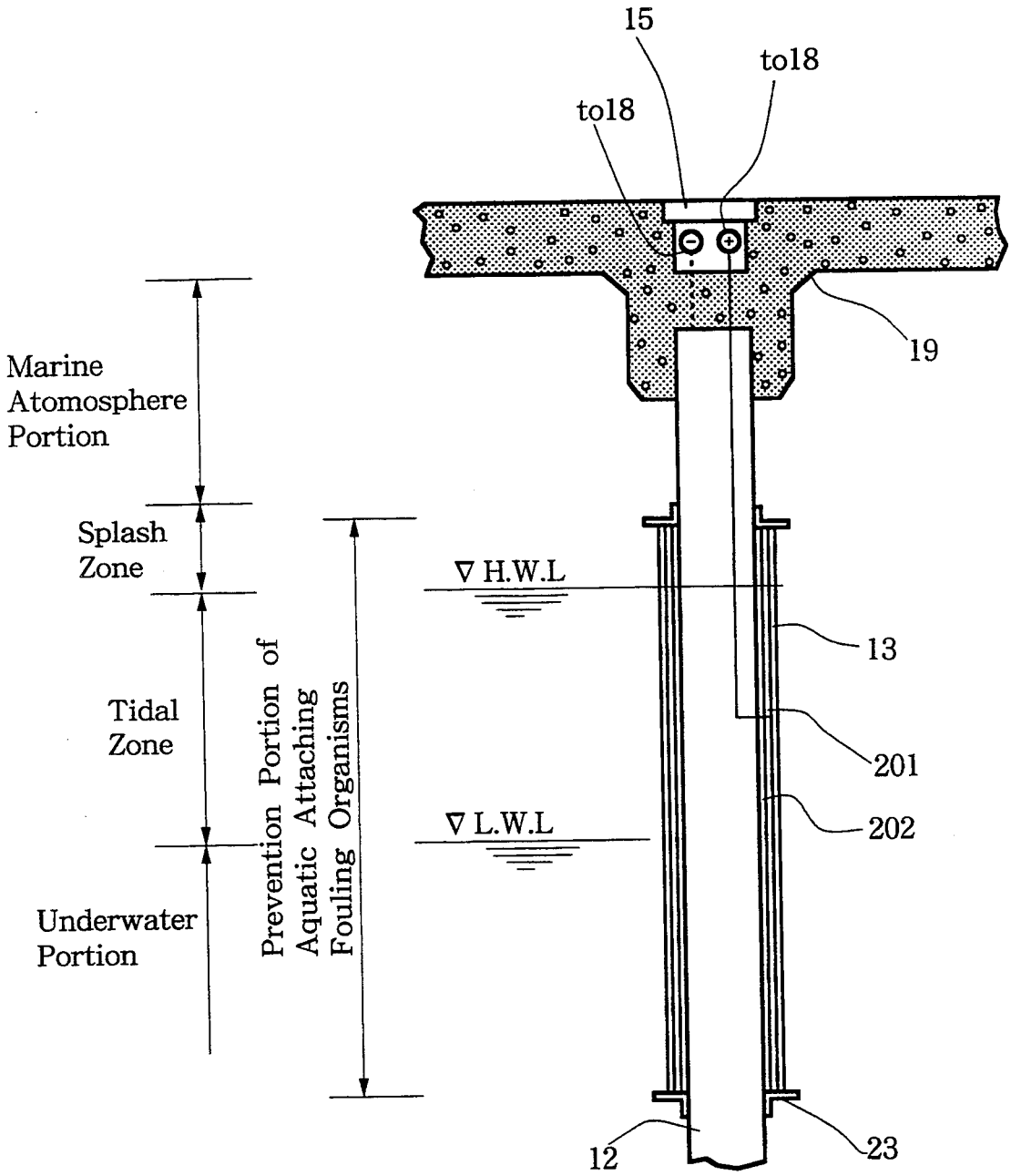
FIG. 13 is a sectional view showing another example where the anti-fouling apparatus for marine organisms is fitted to one base steel pipe pile.

FIG. 13 is a sectional view showing the state where the present invention was applied to the steel pipe piles for substructures. In this drawing, like reference numerals are used to identify like constituents as in FIG. 12. Reference numeral 201 denotes a cushion material and 202 does an insulating material. Since anti-fouling coating was not applied to the steel pipe plies 12, a 2.3 mm-thick steel sheet (metal member) 13 was applied to the steel pipe piles 12 through the insulating material 202 and the cushion material 201 up to a splash zone above H.W.L. In this embodiment, too, in order to use the steel sheet 13 as the anode, the electric contact bonding part was disposed on the steel sheet, and an insulating coating lead wire was fitted, was guided to the connection box 15 provided on the superstructure of pier 19 and was connected to the positive pole of the D.C. power supply 18. On the other hand, another lead wire was connected to the steel pipe piles 12, was taken into the connection box 15 and was connected to the negative pole of the D.C. power supply 18.

An experiment was carried out using this prevention apparatus against the marine organisms in the same way as in Embodiment 6. As a result, although attachment of slimes, seaweeds and extremely small shellfishes was observed at a part of the steel pipe piles, the attaching quantity was extremely small.

EMBODIMENT 8

Figure 14:
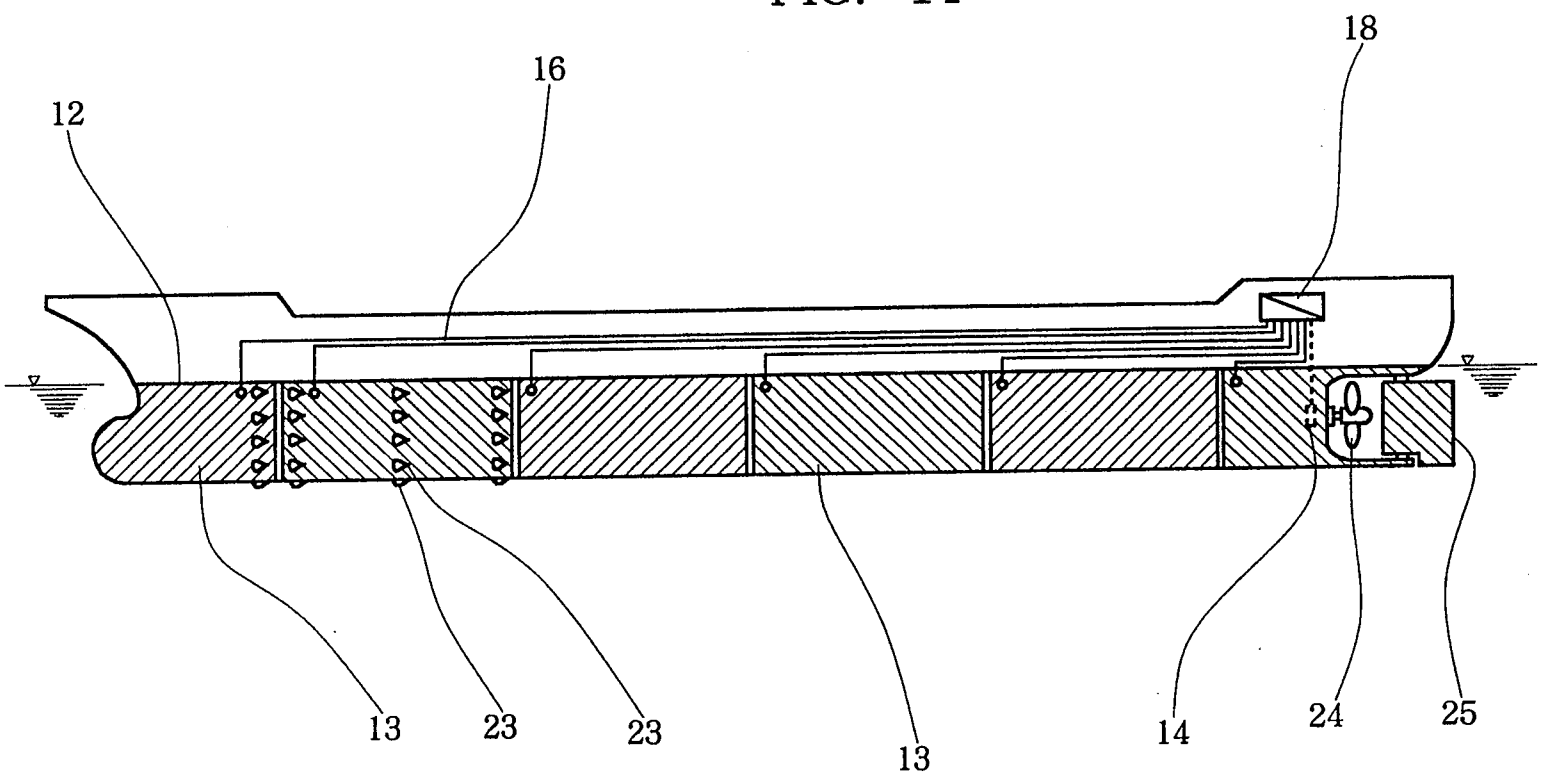
FIG. 14 is a side view showing the state where the present invention is applied to the hull of a ship.
Figure 15:
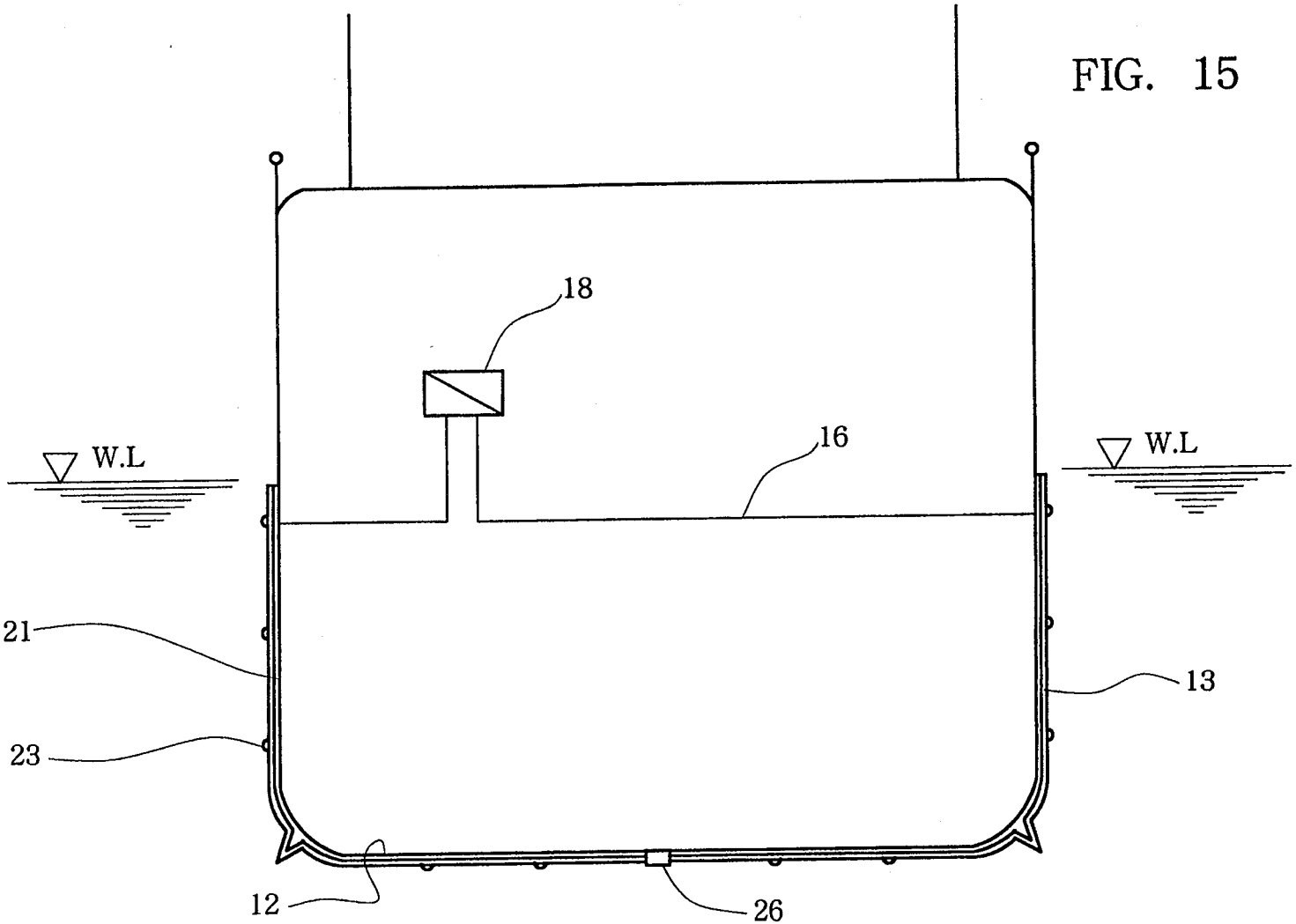
FIG. 15 is a sectional view of FIG. 14.

FIG. 14 is a side view showing another embodiment of the present invention applied to the ship hull, and FIG. 15 is its sectional view.

In FIGS. 14 and 15, like reference numerals are used to identify like constituents as in FIG. 12. Reference numeral 24 denotes a screw propeller, 25 is a rudder, and 26 is an insulation keel, and symbol W.L represents a draught line.

In this embodiment, time steel sheet (metal member ) 13 was fitted through the insulation/cushion material 21 in place of an anti-fouling anti-corrosion paint applied to the ship hull (marine structure) 12. The steel sheet 13 and time insulation/cushion material 21 were produced in advance into a unistructure. To fit this unistructure to the ship hull 12, an adhesive was applied to time insulation/cushion material 20, and fastening was made by the use of stud bolts (fixing means) 23 at necessary portions. The head of each stud bolt 23 was shaped by a streamline cap so as to minimize the water contact resistance.

When the experiment was carried out using this prevention apparatus against the marine organisms, attachment of slimes and extremely small shellfishes was observed partly on the ship hull after the passage of six months, but the attaching quantity was extremely small.

The foregoing embodiments of the invention represent the case of the marine structures and sea water intake facilities constructed in sea brine, but the present invention can of course be applied in the same way to submerged structures constituted in fresh water and brackish water and to intake facilities of power generation plants.

INDUSTRIAL AVAILABILITY

As described above, the present invention can industrially and economically prevent or control aquatic attaching fouling organisms by controlling the current density of the anode as the anti-fouling object in accordance with the life mode of aquatic fouling organisms.

Particularly, the method of the present invention is not the method which eliminates the marine organisms by generating toxic metal ions or forming chlorine and hypochlorites, but is the prevention method of the attaching fouling organisms on the basis of active dissolution of intoxic metals. Since the anode current density for limiting the quantity deposition of the aquatic fouling organisms to an allowable value is now clarified, the operation management becomes easy, and the service life of the anode can be estimated.

Furthermore, the reduction of power consumption and a further extension of the service life of the anode become possible by regulating the anode current density In accordance with the seasons, that is, in accordance with activity (active and non-active) of the aquatic fouling organisms by grasping the life mode of the aquatic fouling organisms in accordance with the season, weather, sites or months.

What is claimed is:

1. A prevention and control method of aquatic fouling organisms, said fouling organisms having attaching portions, comprising the steps of a) covering the surface of a submerged structure or an intake facility with a multilayer body in which said multilayer body is composed of a plurality of mutually insulated metallic plates, said plates being made of one member selected from the group consisting of iron, magnesium, aluminum and alloys thereof through an insulating material and a cushion material:

b) using a pair of said metallic plates facing each other as electrodes, c) composing an electric circuit using said pair of said metallic plates;

d) connecting said electrodes to a DC power supply having a current reversal function;

e) supplying a current with a current density of not more than 500 mA/m$^2$ between said electrodes either continuously or intermittently at an interval of 10 seconds to 60 minutes; and f) reversing the polarity of said current at an interval of 10 seconds to 60 minutes so that when one of said metallic plates is the anode, the surface of said metal constituting said metallic plate is dissolved and activated, and attachment of said aquatic fouling organisms is controlled or prevented.

2. The method according to claim 1 wherein said submerged structure is a harbor or an offshore facility constructed in water or a ship.

3. The method according to claim 1 wherein said intake facility is an intake for cooling water or power generation water.

4. The method according to claim 1 wherein said metallic plate is a sheet-formed material or a formed by plastic working.

5. The method according to claim 1 wherein said DC power supply is combined with an alternating current supply.

6. The method according to claim 1 wherein said submerged structure is covered with a corrison protective layer.

7. The method according to claim 1 wherein said current is supplied with anode current density of 40 to 500 mA/m$^2$.

8. The method according to claim 1 wherein said fouling organisms differ in species and breeding season and said anode current density is changed either regularly or irregularly in accordance with the species of said aquatic fouling organisms or with their breeding season.

9. A prevention and control method of aquatic fouling organisms, said fouling organisms having attaching portions, comprising the steps of a) covering the surface of a submerged structure with a multilayer body in which said multilayer body is composed of a plurality of mutually insulated metallic plates, said plates being made of one member selected from the group consisting of iron, magnesium, aluminum and alloys thereof, through an insulating material and a cushion material to form a metallic cover;

b) connecting said metallic cover to the positive pole of a DC power supply whereby said metallic plate functions as the anode; said anode having a surface;

c) connecting said submerged structure to the negative pole of said DC power supply to use it as a cathode and to form an electric circuit; and d) supplying a current with a current density of not more than 500 mA/m$^2$ between said cathode and said anode either continuously or intermittently at an interval of 10 seconds to 60 minutes so as to control or prevent attachment of said aquatic fouling organisms to the surface of said metallic plate functioning as the anode by dissolving and activating the surface of said metallic plate.

10. The method according to claim 9 wherein said submerged structure is harbor or an offshore facility constructed in water, or ships.

11. The method according to claim 9 wherein said metallic plate is a sheet-formed material or a plastic-formed material.

12. The method according to claim 9 wherein said DC power supply is combined with an alternating current supply.

13. The method according to claim 9 wherein said submerged structure is covered with a corrison protective layer.

14. The method according to claim 9 wherein said current is supplied with anode current density of 40 to 500 mA/m$^2$.

15. The method according to claim 9 wherein said fouling organisms differ in species and breeding season and said anode current density is changed either regularly or irregularly in accordance with the species or with their breeding season.

16. A prevention and control method of aquatic fouling organisms, said fouling organism having attaching portions, comprising the step of a) covering the surface of an intake facility other than its bottom surface with a multilayer body in which said multilayer body is composed of a plurality of mutually insulated metallic plates, said plates being made of one member selected from the group consisting of iron, magnesium, aluminum and alloys thereof through an insulating material and a cushion material to form a metallic cover;

b) connecting said metallic cover to the positive pole of a DC power supply whereby said metallic cover functions as the anode;

c) disposing iron or an iron alloy material on said bottom surface of said intake facility and connecting it to the negative pole of the DC supply whereby said iron or iron alloy material functions as the cathode and an electric circuit is formed;

d) supplying a current with a current density of not more than 500 mA/m$^2$ between said cathode and said anode either continuously or intermittently at an interval of 10 seconds to 60 minutes so that the surface of said metal constituting said metallic cover which functions as the anode is dissolved and activated, and attachment of said aquatic attaching fouling organisms to the surface of said metallic cover is controlled or prevented.

17. The method according to claim 16 wherein said intake facility is an intake pass for cooling water or power generation water.

18. The method according to claim 16 wherein said metallic plate is a sheet-formed material or is formed by plastic working.

19. The method according to claim 16 wherein said DC power supply is combined with an alternating current supply.

20. The method according to claim 16 wherein said current is supplied with an anode current density of 40 to 500 $mA/m^2$.

21. The method according to claim 16 wherein said fouling organisms differ in species and breeding season and said anode current density is changed either regularly or irregularly in accordance with species of said aquatic fouling organisms or with their breeding season.

22. A prevention apparatus against aquatic fouling organisms having attaching positions, comprising:

a multilayer body fitted to the surface of a submerged structure or an intake facility in which said multilayer body is composed of a plurality of mutually insulated metallic plates made of one member selected from the group consisting of iron, magnesium, aluminum and alloys thereof through an insulating material and a cushion material; and a DC power supply capable of supplying a current between said metallic plates or between one of said metallic plate and said submerged structure.

23. A prevention apparatus against aquatic attaching fouling organisms according to claim 22 wherein said DC power supply constitutes an electric circuit having a current reversal function, an intermittent current supply function or a DC power supply combined with an AC current supply.

24. A prevention apparatus against aquatic fouling organisms having attaching portions, comprising:

a multilayer body fitted to the inner surface of an intake facility other than its bottom surface in which said multilayer body is composed of a plurality of mutually insulated metallic plates made of one member selected from the group consisting of iron, magnesium, aluminum and alloys thereof through an insulating material and a cushion material;

an iron member or its alloy member disposed on such bottom surface of said intake facility; and a DC current supply capable of supplying a current between said metallic plates and said iron or said alloy member.

25. A prevention apparatus against aquatic attaching fouling organisms according to claim 24 wherein said DC power supply constitutes an electric circuit having a current reversal function, an intermittent current supply function or a DC power supply combined with an AC current supply.

* * * * *